US011697785B2

(12) United States Patent
Oppilliart et al.

(10) Patent No.: US 11,697,785 B2
(45) Date of Patent: Jul. 11, 2023

(54) LUBRICANT COMPOSITION FOR A GAS ENGINE

(71) Applicant: TOTAL MARKETING SERVICES, Puteaux (FR)

(72) Inventors: Sophie Oppilliart, Lyons (FR); Santiago Carreras, Le Pecq (FR); Erwan Bertho, Grigny (FR)

(73) Assignee: TOTAL MARKETING SERVICES, Puteaux (FR)

( * ) Notice: Subject to any disclaimer, the term of this patent is extended or adjusted under 35 U.S.C. 154(b) by 0 days.

(21) Appl. No.: 16/314,997

(22) PCT Filed: Jul. 6, 2017

(86) PCT No.: PCT/EP2017/066886
§ 371 (c)(1),
(2) Date: Jan. 3, 2019

(87) PCT Pub. No.: WO2018/007497
PCT Pub. Date: Jan. 11, 2018

(65) Prior Publication Data

US 2019/0203152 A1 Jul. 4, 2019

(30) Foreign Application Priority Data

Jul. 7, 2016 (FR) ..... 1656524

(51) Int. Cl.

| | |
|---|---|
| ***C10M 111/02*** | (2006.01) |
| ***C10M 169/04*** | (2006.01) |
| ***C10M 129/74*** | (2006.01) |
| ***C10M 143/06*** | (2006.01) |
| ***C10M 161/00*** | (2006.01) |
| *C10N 30/04* | (2006.01) |
| *C10N 30/08* | (2006.01) |
| *C10N 30/10* | (2006.01) |
| *C10N 30/00* | (2006.01) |
| *C10N 40/25* | (2006.01) |

(52) U.S. Cl.
CPC ..... *C10M 169/044* (2013.01); *C10M 111/02* (2013.01); *C10M 129/74* (2013.01); *C10M 143/06* (2013.01); *C10M 161/00* (2013.01); *C10M 2203/003* (2013.01); *C10M 2203/1006* (2013.01); *C10M 2203/1025* (2013.01); *C10M 2205/026* (2013.01); *C10M 2207/023* (2013.01); *C10M 2207/026* (2013.01); *C10M 2207/028* (2013.01); *C10M 2207/283* (2013.01); *C10M 2207/2835* (2013.01); *C10M 2207/30* (2013.01); *C10M 2209/084* (2013.01); *C10M 2215/28* (2013.01); *C10M 2219/046* (2013.01); *C10M 2223/045* (2013.01); *C10N 2030/04* (2013.01); *C10N 2030/08* (2013.01); *C10N 2030/10* (2013.01); *C10N 2030/70* (2020.05); *C10N 2040/25* (2013.01); *C10N 2040/255* (2020.05)

(58) Field of Classification Search
CPC ..... C10M 169/044; C10M 111/02; C10M 129/74; C10M 143/06; C10M 161/00; C10M 2209/084; C10M 2207/026; C10M 2223/045; C10N 2030/04; C10N 2030/08; C10N 2030/10; C10N 2030/70; C10N 2040/25; C10N 2040/255
USPC ..... 508/485, 463
See application file for complete search history.

(56) References Cited

U.S. PATENT DOCUMENTS

| | | | | |
|---|---|---|---|---|
| 5,458,794 | A | 10/1995 | Bardasz et al. | |
| 2007/0184991 | A1* | 8/2007 | Winemiller ..... | C10M 169/045 508/192 |
| 2011/0059877 | A1 | 3/2011 | Obiols et al. | |
| 2012/0201962 | A1 | 8/2012 | Kawata et al. | |
| 2016/0053194 | A1* | 2/2016 | Beyer ..... | C10M 105/32 508/492 |

FOREIGN PATENT DOCUMENTS

| | | | |
|---|---|---|---|
| EP | 0 712 834 | A1 | 5/1996 |
| EP | 0 790 294 | A2 | 8/1997 |
| EP | 2 102 321 | A1 | 9/2009 |
| EP | 2 261 309 | A1 | 12/2010 |
| EP | 2 396 394 | A1 | 12/2011 |
| EP | 2 441 818 | A1 | 4/2012 |
| EP | 2 607 462 | A1 | 6/2013 |
| JP | 7-173478 | A | 7/1995 |
| JP | H09-071795 | A | 3/1997 |
| JP | 2000-008061 | A | 1/2000 |
| JP | 2009-513781 | A | 4/2009 |
| JP | 2009-249496 | A | 10/2009 |
| JP | 2011-006531 | A | 1/2011 |
| JP | 2011-505484 | A | 2/2011 |
| JP | 4 702052 | B2 | 6/2011 |
| WO | 2007/050451 | A2 | 5/2007 |
| WO | 2007/061699 | A2 | 5/2007 |
| WO | 2008/079715 | A1 | 3/2008 |
| WO | 2010/093519 | A1 | 8/2010 |

OTHER PUBLICATIONS

FR Search Report, dated Oct. 19, 2016, from corresponding FR 1656524 application.
International Search Report, dated Sep. 18, 2017, from corresponding PCT/EP2017/066886 application.

* cited by examiner

*Primary Examiner* — Prem C Singh
*Assistant Examiner* — Francis C Campanell
(74) *Attorney, Agent, or Firm* — Nixon & Vanderhye

(57) ABSTRACT

Disclosed is a method of lubricating a gas engine using a lubricant including at least one mineral base oil and at least one ester selected from among the polyol esters. The composition includes at least 50% by weight of mineral base oil and at least 5% by weight of polyol ester relative to the total weight of the lubricant composition.

14 Claims, No Drawings

LUBRICANT COMPOSITION FOR A GAS ENGINE

The present invention relates to the field of lubricants for gas engines, preferably for stationary gas engines. The present invention relates more particularly to the use of a lubricant composition comprising at least one mineral base oil and at least one ester chosen from among polyol esters for lubricating a gas engine, preferably for a stationary gas engine.

The present invention also relates to a method of lubricating a gas engine, preferably a stationary gas engine.

Lubricants developed specifically for the lubrication of gas engines, preferably stationary gas engines have been known for several years. The first lubricants dedicated to this application contained Group I base oils according to the API classification. These lubricants offered good behavior at high temperature, in particular they did not form any, or few, deposits but had a limited resistance to oxidation, in particular nitroxidation. By nitroxidation is meant oxidation by contact with nitrogen oxides (NOx).

The lubricants then incorporated API Group II base oils to improve oxidation resistance. However, and particularly in the case of very high power gas engines, the use of these lubricants resulted in the formation of high temperature deposition (or varnish). This also applies to lubricants based on Group III and Group IV base oils according to the API classification.

There is therefore a need for lubricant compositions for the lubrication of a gas engine, preferably for a stationary gas engine, having good detergency properties and thus forming no, or little, deposition, in particular at high temperature, while presenting satisfactory or even improved resistance to oxidation, in particular to nitroxidation.

It has now been found that the combination of at least one mineral base oil and at least one ester chosen from among polyol esters makes it possible to provide a lubricant composition dedicated to the lubrication of gas engines, preferably stationary gas engines, offering resistance to oxidation, in particular satisfactory or improved nitroxidation, and with little or no deposition, especially at high temperature.

Thus, the invention provides a lubricant composition which makes it possible to provide a solution to all or part of the problems of lubricant compositions intended for the lubrication of gas engines, preferably stationary gas engines.

The present invention therefore relates to the use of a lubricant composition comprising at least one mineral base oil and at least one ester chosen from among polyol esters for lubricating a gas engine.

Surprisingly, the applicant has found that the combination of at least one mineral base oil and at least one ester chosen from among polyol esters in a lubricant composition for a gas engine, preferably for a stationary gas engine, makes it possible to improve the resistance to oxidation, especially to nitroxidation, of the lubricant composition.

Advantageously, the lubricant compositions according to the invention offer both good resistance to oxidation, especially to nitroxidation, while reducing or even eliminating the formation of deposits, especially at high temperature.

Advantageously, the lubricant compositions according to the invention offer good oxidation resistance properties, especially to nitroxidation, and detergency when implemented in a gas engine and whose formulation is easy to implement.

Advantageously, the lubricant compositions according to the invention offer good oxidation resistance properties, especially nitroxidation, and detergency properties when implemented in a gas engine while being stable over time, in particular stable when stored.

In one embodiment of the invention, the gas engine is a stationary gas engine.

In one embodiment of the invention, the mineral base oil is chosen from a Group II base oil or a Group III base oil according to the API classification, preferably a Group II base oil according to the API classification.

In another embodiment of the invention, the lubricant composition comprises at least 50% by weight, preferably from 50% to 90% by weight, of mineral base oil relative to the total weight of the lubricant composition.

In another embodiment of the invention, the ester is chosen from among saturated or unsaturated, linear or branched carboxylic and polyol esters comprising at least 8 carbon atoms.

In another embodiment of the invention, the carboxylic acid is a saturated or unsaturated monocarboxylic acid, linear or branched.

In another embodiment of the invention, the carboxylic acid comprises from 8 to 20 carbon atoms, preferably from 8 to 18 carbon atoms.

In another embodiment of the invention, the polyol comprises at least 3 —OH groups, preferably from 3 to 8 —OH groups.

In another embodiment of the invention, the polyol comprises from 3 to 10 carbon atoms.

In another embodiment of the invention, the polyol ester comprises a mixture of at least a first ester of polyol and of monocarboxylic acid as defined above, and at least one second ester of polyol and of monocarboxylic acid as defined above, and different from the first ester.

In another embodiment of the invention, the ester is obtained by esterification reaction between a polyol as defined above, at least one first monocarboxylic acid as defined above, and at least one second carboxylic acid that is selected from linear or branched, saturated or unsaturated, dicarboxylic acids comprising at least 16 carbon atoms.

In another embodiment of the invention, the lubricant composition comprises at least 2% by weight, preferably at least 5% by weight, of polyol ester relative to the total weight of the lubricant composition.

In another embodiment of the invention, the lubricant composition further comprises polyisobutylene.

The invention also relates to the use of at least one mineral base oil as defined above and at least one ester chosen from among the polyol esters as defined above in a lubricant composition for lubricating a gas engine.

The invention also relates to a method of lubricating a gas engine comprising contacting at least one mechanical part of the engine with a lubricant composition as defined above.

DETAILED DESCRIPTION OF THE INVENTION

The percentages given below correspond to percentages by weight of active ingredient.

The lubricant composition according to the invention comprises at least one mineral base oil.

The mineral base oils used in the lubricant compositions according to the invention may be oils of mineral origin belonging to groups I, II or III according to the classes defined in the API classification (or their equivalents according to the ATIEL classification) (Table A) or their mixtures.

TABLE A

| | Saturated content | Sulfur content | Viscosity index (VI) |
|---|---|---|---|
| Group I Mineral oils | <90% | >0.03% | 80 ≤ VI < 120 |
| Group II Hydrocracked oils | ≥90% | ≤0.03% | 80 ≤ VI < 120 |
| Group III Hydrocracked or hydro-isomerized oils | ≥90% | ≤0.03% | ≥120 |
| Group IV | Poyalphaolefines (PAO) | | |
| Group V | Esters and other bases not included in groups I to IV | | |

In a preferred embodiment of the invention, the base oil is a Group II base oil or a Group III base oil according to the API classification.

In a more preferred embodiment of the invention, the base oil is a Group II base oil according to the API classification.

In another preferred embodiment of the invention, the lubricant composition comprises at least 50%, preferably from 50% to 90%, more preferably from 60% to 90%, even more preferably from 65% to 90%, advantageously from 65% to 85% by weight of mineral base oil based on the total weight of the lubricant composition.

In another more preferred embodiment of the invention, the lubricant composition comprises at least 70%, preferably from 70% to 90%, more preferably from 75% to 90%, advantageously from 75% to 85% by weight of mineral base oil with respect to the total weight of the lubricant composition.

The lubricant composition according to the invention also comprises at least one ester chosen from among polyol esters.

By polyol ester according to the invention is meant any ester obtained by esterification of at least one carboxylic acid with at least one polyol.

By carboxylic acid according to the invention is meant monocarboxylic acids and polycarboxylic acids.

In one embodiment of the invention, the ester is chosen from among saturated or unsaturated, linear or branched polyol esters of carboxylic acids comprising at least 8 carbon atoms.

In a preferred embodiment of the invention, the carboxylic acid is a saturated or unsaturated monocarboxylic acid, linear or branched.

The carboxylic acid may thus be chosen from among:

saturated and linear monocarboxylic acids;

unsaturated and linear monocarboxylic acids;

saturated and branched monocarboxylic acids;

unsaturated and branched monocarboxylic acids.

In another preferred embodiment of the invention, the carboxylic acid comprises from 8 to 20 carbon atoms, preferably from 8 to 18 carbon atoms.

In a particular embodiment of the invention, the carboxylic acid comprises from 14 to 18 carbon atoms, preferably from 16 to 18 carbon atoms.

In another particular embodiment of the invention, the carboxylic acid comprises from 8 to 12 carbon atoms, preferably from 8 to 10 carbon atoms.

Thus, the carboxylic acid may be chosen from among:

saturated and linear monocarboxylic acids comprising from 8 to 20 carbon atoms, preferably from 8 to 18 carbon atoms, more preferably from 14 to 18 carbon atoms, advantageously from 16 to 18 carbon atoms;

unsaturated and linear monocarboxylic acids comprising from 8 to 20 carbon atoms, preferably from 8 to 18 carbon atoms, more preferably from 14 to 18 carbon atoms, advantageously from 16 to 18 carbon atoms;

saturated and branched monocarboxylic acids comprising from 8 to 20 carbon atoms, preferably from 8 to 18 carbon atoms, more preferably from 14 to 18 carbon atoms, advantageously from 16 to 18 carbon atoms;

unsaturated and branched monocarboxylic acids comprising from 8 to 20 carbon atoms, preferably from 8 to 18 carbon atoms, more preferably from 14 to 18 carbon atoms, advantageously from 16 to 18 carbon atoms.

The carboxylic acid may also be chosen from among:

saturated and linear monocarboxylic acids comprising from 8 to 12 carbon atoms, preferably from 8 to 10 carbon atoms;

unsaturated and linear monocarboxylic acids comprising from 8 to 12 carbon atoms, preferably from 8 to 10 carbon atoms;

saturated and branched monocarboxylic acids comprising from 8 to 12 carbon atoms, preferably from 8 to 10 carbon atoms;

unsaturated and branched monocarboxylic acids comprising from 8 to 12 carbon atoms, preferably from 8 to 10 carbon atoms.

Examples of carboxylic acids according to the invention include pelargonic acid, stearic acid, isostearic acid or oleic acid.

In another preferred embodiment of the invention, the polyol comprises at least 3 —OH groups, preferably 3 to 8 —OH groups, more preferably 3 to 6 —OH groups.

In a more preferred embodiment of the invention, the polyol comprises 3, 4 or 6 —OH groups.

In another preferred embodiment of the invention, the polyol comprises from 3 to 10 carbon atoms, preferably from 3 to 8 carbon atoms, more preferably from 3 to 6 carbon atoms.

Examples of polyols according to the invention include glycerol, trimethylolpropane, pentaerythritol or dipentaerythritol.

In a particular embodiment of the invention, the polyol ester comprises a mixture of at least one first ester of polyol and of monocarboxylic acid as defined above and at least one second ester of polyol and of monocarboxylic acid as defined above and different from the first ester.

In a more particular embodiment of the invention, the ester comprises a mixture of:

at least one triester of polyol and of monocarboxylic acid, at least one diester of polyol and of monocarboxylic acid, wherein the polyol and the monocarboxylic acid are as defined above.

In an even more particular embodiment of the invention, the ester comprises a mixture of:

at least one triester of trimethylpropane and saturated or unsaturated monocarboxylic acid, preferably saturated comprising from 14 to 18 carbon atoms, advantageously from 16 to 18 carbon atoms, at least one diester of trimethylpropane and saturated or unsaturated monocarboxylic acid, preferably saturated comprising from 14 to 18 carbon atoms, advantageously from 16 to 18 carbon atoms.

As an example of polyol ester according to the invention, mention may be made of Radialube 7250® sold by the company Oleon.

In another particular embodiment of the invention, the ester is obtained by esterification reaction between a polyol as defined above, at least one first monocarboxylic acid as defined above, and at least one second carboxylic acid chosen from linear or branched, saturated or unsaturated dicarboxylic acids comprising at least 16 carbon atoms.

In another more particular embodiment of the invention, the ester is obtained by esterification reaction between:

- a polyol comprising 3 or 4 —OH groups and from 3 to 6 carbon atoms,
- at least one first saturated monocarboxylic acid, linear or branched, comprising from 8 to 20 carbon atoms, preferentially from 8 to 18 carbon atoms, and
- at least one second carboxylic acid chosen from among saturated, linear or branched dicarboxylic acids comprising at least 16 carbon atoms.

In another more particular embodiment of the invention, the ester is obtained by esterification reaction between:

- a polyol chosen from pentaerythritol or trimethylolpropane,
- at least one first saturated or unsaturated monocarboxylic acid, linear or branched comprising from 8 to 18 carbon atoms, and
- at least one second carboxylic acid chosen from saturated, linear or branched dicarboxylic acids comprising from 16 to 36 carbon atoms.

In another more particular embodiment of the invention, the ester is obtained by esterification reaction between:

- pentaerythritol,
- at least one first saturated or unsaturated monocarboxylic acid, linear or branched, comprising 18 carbon atoms, and
- at least one second carboxylic acid chosen from among saturated, linear or branched dicarboxylic acids comprising from 16 to 36 carbon atoms.

As an example of polyol ester according to the invention, mention may be made of Priolube 1847® marketed by the company Croda, or Nycobase 8851® marketed by the company NYCO.

In another particular embodiment of the invention, the ester is obtained by esterification reaction between a polyol as defined above and at least one saturated or unsaturated monocarboxylic acid, linear or branched, comprising from 8 to 12 carbon atoms, preferably 8 to 10 carbon atoms.

In another more particular embodiment of the invention, the ester is obtained by esterification reaction between:

- dipentaerythritol, and
- at least one saturated or unsaturated monocarboxylic acid, linear or branched, comprising from 8 to 12 carbon atoms, preferably from 8 to 10 carbon atoms.

In one embodiment of the invention, the lubricant composition comprises at least 2% by weight, preferably at least 5% by weight, more preferably 5% to 30%, advantageously 5% to 25%, or 5% to 15% by weight of polyol ester based on the total weight of the lubricant composition.

The lubricant composition according to the invention may also comprise an additional base oil chosen from Group I, IV or V oils according to the API classification as defined above, with the exception of the polyol esters according to the invention.

The additional base oil according to the invention may, in particular, be chosen from among synthetic oils, such as polyalkylene glycols, and from among polyalphaolefins. The polyalphaolefins used as base oils are, for example, obtained from monomers comprising from 4 to 32 carbon atoms, for example from octene or decene, and whose kinematic viscosity at 100° C. is between 1.5 and 15 $mm^2.s^{-1}$ according to ASTM D445. Their average molecular weight is generally between 250 and 3000 according to ASTM D5296.

Many additives may be used in the lubricant composition used according to the invention.

The additives for the lubricant composition used according to the invention may be chosen, in particular, from among friction modifiers, detergents, antiwear additives, extreme pressure additives, viscosity index improvers, dispersants, antioxidants, pour point improvers, defoamers, thickeners and mixtures thereof.

The anti-wear additives and extreme pressure additives protect the friction surfaces by forming a protective film adsorbed on these surfaces.

There is a wide variety of anti-wear additives. In a preferred manner for the lubricant composition according to the invention, the anti-wear additives are chosen from among phospho-sulfur-containing additives such as metal alkylthiophosphates, in particular zinc alkylthiophosphates, and more specifically zinc dialkyldithiophosphates (ZnDTP). The preferred compounds have the formula $Zn((SP(S)(OR^1)(OR^2))_2$, wherein $R^1$ and $R^2$, which may be identical or different, independently represent an alkyl group, preferably an alkyl group comprising from 1 to 18 carbon atoms.

Amine phosphates are also anti-wear additives that may be used in the lubricant composition according to the invention. However, the phosphorus provided by these additives may act as a poison of the catalytic systems of automobiles because these additives are ash generators. These effects may be minimized by partially substituting the amine phosphates with non-phosphorus additives, such as, for example, polysulfides, especially sulfur-containing olefins.

Advantageously, the lubricant composition according to the invention may comprise from 0.01 to 6% by weight, preferably from 0.05 to 4% by weight, more preferably from 0.1 to 2% by weight relative to the total weight of lubricant composition, anti-wear additives and extreme pressure additives.

Advantageously, the lubricant composition according to the invention may comprise at least one friction-modifying additive. The friction modifying additive may be chosen from a compound providing metallic elements and an ash-free compound. Among the compounds providing metal elements, mention may be made of transition metal complexes such as Mo, Sb, Sn, Fe, Cu and Zn, the ligands of which may be hydrocarbon compounds comprising oxygen, nitrogen, sulfur or phosphorus. The ashless friction modifier additives are generally of organic origin and may be selected from among alkoxylated amines, alkoxylated fatty amines, fatty epoxides, borate fatty epoxides, or fatty amines. According to the invention, the fatty compounds comprise at least one hydrocarbon group comprising from 10 to 24 carbon atoms.

Advantageously, the lubricant composition according to the invention may comprise from 0.01 to 2% by weight or from 0.01 to 5% by weight, preferably from 0.1 to 1.5% by weight or 0.1 at 2% by weight relative to the total weight of the lubricant composition and friction modifier additive.

Advantageously, the lubricant composition according to the invention may comprise at least one antioxidant additive.

The antioxidant additive generally serves to retard the degradation of the lubricant composition in use. This degradation may, in particular, result in the formation of deposits, the presence of sludge or an increase in the viscosity of the lubricant composition.

Antioxidant additives act, in particular, as radical inhibitors or destroyers of hydroperoxides. Among antioxidant additives commonly used, mention may be made of antioxidant additives of the phenolic type, antioxidant additives of the amine type, antioxidant phosphosulfur additives. Some of these antioxidant additives, for example antioxidant phosphosulfur additives, may be ash generators. Antioxidant phenolic additives may be ash-free or may be in the form of neutral or basic metal salts. The antioxidant additives may, in particular, be chosen from among sterically hindered phenols, sterically hindered phenol esters and sterically hindered phenols comprising a thioether bridge, diphenylamines, diphenylamines substituted with at least one $C_1$-$C_{12}$ alkyl group, and N,N'-dialkyl-aryl diamines and mixtures thereof.

Preferably, according to the invention, the sterically hindered phenols are chosen from among compounds comprising a phenol group in which at least one vicinal carbon of the carbon bearing the alcohol function is substituted by at least one $C_1$-$C_{10}$ alkyl group, preferably a $C_1$-$C_6$ alkyl group, preferably a $C_4$ alkyl group, preferably by the ter-butyl group.

Amino compounds are another class of antioxidant additives that may be used, optionally in combination with antioxidant phenolic additives. Examples of amine compounds are aromatic amines, for example aromatic amines of formula $NR^3R^4R^5$, wherein $R^3$ represents an optionally substituted aliphatic or aromatic group, $R^4$ represents an optionally substituted aromatic group, $R^5$ represents a hydrogen atom, an alkyl group, an aryl group or a group of formula $R^6S(O)_zR^7$, wherein $R^6$ represents an alkylene group or an alkenylene group, $R^7$ represents an alkyl group, an alkenyl group or an aryl group and z represents 0, 1 or 2.

Sulfurized alkyl phenols or their alkali and alkaline earth metal salts may also be used as antioxidant additives.

Another class of antioxidant additives is copper compounds, for example copper thio- or dithio-phosphates, copper and carboxylic acid salts, dithiocarbamates, sulphonates, phenates, copper acetylacetonates. The copper salts I and II, succinic acid or anhydride salts may also be used.

The lubricant composition according to the invention may contain all types of antioxidant additives known to those skilled in the art.

Advantageously, the lubricant composition may comprise at least one ash-free antioxidant additive.

Also advantageously, the lubricant composition according to the invention may comprise from 0.5 to 2% by weight of at least one antioxidant additive relative to the total weight of the composition.

The lubricant composition according to the invention may also comprise at least one detergent additive.

The detergent additives generally make it possible to reduce the formation of deposits on the surface of the metal parts by dissolving the secondary oxidation and combustion products.

The detergent additives that may be used in the lubricant composition according to the invention are generally known to those skilled in the art. The detergent additives may be anionic compounds comprising a long lipophilic hydrocarbon chain and a hydrophilic head. The associated cation may be a metal cation of an alkali metal or alkaline earth metal.

The detergent additives are preferably chosen from the alkali metal or alkaline earth metal salts of carboxylic acids, the sulphonates, the salicylates, the naphthenates and the phenate salts. The alkali and alkaline earth metals are preferably calcium, magnesium, sodium or barium.

These metal salts generally comprise the metal in stoichiometric amount or in excess, therefore in an amount greater than the stoichiometric amount. This then relates to overbased detergent additives; wherein the excess metal bringing the overbased character to the detergent additive is then generally in the form of a metal salt that is insoluble in oil, for example a carbonate, a hydroxide, an oxalate, an acetate, a glutamate, preferably a carbonate.

Advantageously, the lubricant composition according to the invention may comprise from 0.5 to 4% by weight of detergent additive relative to the total weight of the lubricant composition.

Also advantageously, the lubricant composition according to the invention may also comprise at least one pour point depressant additive.

By slowing the formation of paraffin crystals, pour point depressant additives generally improve the cold behavior of the lubricant composition according to the invention.

As examples of pour point depressant additives, mention may be made of alkyl polymethacrylates, polyacrylates, polyarylamides, polyalkylphenols, polyalkylnaphthalenes and alkylated polystyrenes.

Advantageously, the lubricant composition according to the invention may also comprise at least one dispersing agent.

The dispersing agent may be chosen from among Mannich bases, succinimides and their derivatives.

Also advantageously, the lubricant composition according to the invention may comprise from 0.2 to 10% by weight of dispersing agent relative to the total weight of the lubricant composition.

The lubricant composition of the present invention may also comprise at least one thickener, such as for example polyisobutylene or its derivatives.

In a preferred embodiment of the invention, the lubricant composition may comprise polyisobutylene as a thickener.

Such an embodiment makes it possible, in particular, to further improve the detergency properties of the lubricant composition, especially at high temperature.

Advantageously, the lubricant composition according to the invention may comprise from 0.1 to 5% by weight of thickener relative to the total weight of the lubricant composition.

The lubricant composition of the present invention may also comprise at least one viscosity index improving additive. Examples of additives improving the viscosity index include polymeric esters, homopolymers or copolymers, hydrogenated or non-hydrogenated, styrene, butadiene and isoprene, polyacrylates, polymethacrylates (PMA), or, alternatively, olefin copolymers, especially ethylene/propylene copolymers.

The lubricant composition according to the invention may be in various forms. The lubricant composition according to the invention may, in particular, be an anhydrous composition.

Preferably, this lubricant composition is not an emulsion.

Preferably, the lubricant composition according to the invention is characterized by a KV100 (measured according to ASTM D445) greater than or equal to 12 cSt, preferably from 12 to 17 cSt.

The lubricant composition defined above is used to lubricate a gas engine.

The lubricant composition defined above is used to lubricate a gas engine using any type of gas, especially gas having a low methane number, preferably less than 80, more preferably less than 60.

It should be understood that the lower the value of the methane number, the lower is the combustion quality of the gas.

By gas engine according to the invention is meant more particularly:

stationary gas engines;

mobile gas engines, in particular: gas engines for vehicles, including heavy goods vehicles or vehicles for public transport such as buses, but also marine vehicles such as boats.

In a preferred embodiment, the lubricant composition defined above is used to lubricate a stationary gas engine.

The invention also relates to the use of at least one mineral base oil and at least one ester selected from among polyol esters in a lubricant composition for lubricating a gas engine.

All the characteristics and preferences described for the mineral base oil, the polyol ester and the gas engine above also apply to this use.

The invention also relates to a method of lubricating a gas engine comprising contacting at least one mechanical part of the engine with a lubricant composition comprising at least one mineral base oil and at least one ester chosen from among polyol esters.

All the characteristics and preferences described for the lubricant composition and for the gas engine above also apply to this method.

The various aspects of the invention may be illustrated by the following nonlimiting examples:

EXAMPLE 1

Preparation of a Lubricant Composition According to the Invention

The various components of a lubricant composition according to the invention CL1 are mixed as a function of the nature and the quantities of products presented in Table 1. The percentages indicated correspond to weight percentages.

TABLE 1

| | Lubricant composition according to the invention CL1 (% by mass) |
|---|---|
| Group III oil (KV100 = 7.1 $mm^2/s$ measured according to ASTM D445) | 68.00 |
| Polyol ester (Priolube 1847 ®) | 23.14 |
| Package of additives (phenolic type antioxidant, polymethacrylate pour point depressant, zinc dithiophosphate anti-wear agent, succinimide derivative type dispersant, sulfonate detergent and calcium phenate) | 8.86 |

TABLE 1-continued

| | Lubricant composition according to the invention CL1 (% by mass) |
|---|---|

EXAMPLE 2

Evaluation of the Oxidation Performance of the CL1 Lubricant Composition

This evaluation consists in subjecting the lubricant composition to oxidation with nitrogen oxides at a temperature of 150° C. and for 48 hours.

The oxidation resistance is evaluated by measuring the difference in kinematic viscosity at 100° C. measured according to ASTM D445 before and after oxidation and expressed as a percentage increase in viscosity; the lower the percentage, the better is the resistance to oxidation.

A percentage increase in viscosity of less than or equal to 35% corresponds to acceptable oxidation resistance.

The results are described in Table 2.

TABLE 2

| | CL1 |
|---|---|
| Oxidation resistance | 32 |

The results show that a lubricant composition according to the invention has an acceptable resistance to oxidation.

EXAMPLE 3

Preparation of Lubricant Compositions According to the Invention

The various components of the lubricant compositions according to the invention CL2, CL3 and CL4 and the comparative lubricant composition CC1 are mixed according to the nature and the quantities of products presented in Table 3.

The percentages indicated correspond to mass percentages.

TABLE 3

| | Lubricant composition according to the invention CL2 | Lubricant composition according to the invention CL3 | Lubricant composition according to the invention CL4 | Comparative lubricant composition CC1 |
|---|---|---|---|---|
| Group II oil (KV100 = 10.4 $mm^2/s$ measured according to ASTM D445) | 83.14 | 81.14 | 81.14 | 91.14 |
| Polyol ester (Priolube 1847 ® marketed by the company CRODA) | 8.00 | | | |
| Polyol ester (Radialube 7250 ® marketed by the company Oleon) | | 10.00 | | |

TABLE 3-continued

| | Lubricant composition according to the invention CL2 | Lubricant composition according to the invention CL3 | Lubricant composition according to the invention CL4 | Comparative lubricant composition CC1 |
|---|---|---|---|---|
| Polyol ester (Nycobase 8851 ® marketed by NYCO) | | | 10.00 | |
| Package of additives (phenolic-type antioxidant, polymethacrylate pour point depressant, zinc dithiophosphate anti-wear, succinimide derivative, sulfonate detergent and calcium phenate) | 8.86 | 8.86 | 8.86 | 8.86 |

EXAMPLE 4

Storage Stability Evaluation of CL2, CL3 and CL4 Lubricant Compositions

This visual evaluation is performed at room temperature and is based on the appearance of haze in the composition.

The results are described in Table 4.

TABLE 4

| | CL2 | CL3 | CL4 |
|---|---|---|---|
| Stability in storage | Stable | Stable | Stable |

The results show that the lubricant compositions according to the invention are stable over time.

EXAMPLE 5

Evaluation of the Detergent Properties of Lubricant Compositions CL2 and CC1

This evaluation is performed by a PCT test according to GFC Lu29-A-15.

The higher the value of the rating, the better the detergency properties of the lubricant composition.

The results are described in Table 5.

TABLE 5

| | CL2 | CC1 |
|---|---|---|
| Piston merit rating | 9.2 | 7.5 |

The results show that the lubricant compositions according to the invention have improved detergency properties, especially at high temperature.

EXAMPLE 6

Preparation of Lubricant Compositions According to the Invention

The various components of the lubricant compositions according to the invention CL5, CL6, CL7, CL8, CL9 and CL10, and the comparative lubricant composition CC2, are mixed according to the nature and the quantities of products presented in Table 6. The percentages indicated correspond to weight percentages.

TABLE 6

| | Lubricant composition according to the | Lubricant composition according to the | Lubricant composition according to the | Lubricant composition according to the | Lubricant composition according to the | Lubricant composition according to the | Comparative lubricant composition CC2 |
|---|---|---|---|---|---|---|---|
| Group II oil (KV100 = 10.2 $mm^2/s$ measured according to ASTM D445) | 81.14 | 78.74 | 81.14 | 78.74 | 81.14 | 78.74 | 88.74 |
| Polyol ester (Priolube 1847 ® marketed by the company CRODA) | 10.00 | 10.00 | | | | | |
| Polyol ester (Nycobase 8851 ® marketed by NYCO) | | | 10.00 | 10.00 | | | |
| Polyol ester (Radialube 7250 ® marketed by the company Oleon) | | | | | 10.00 | 10.00 | |

TABLE 6-continued

| | Lubricant composition according to the | Lubricant composition according to the | Lubricant composition according to the | Lubricant composition according to the | Lubricant composition according to the | Lubricant composition according to the | Comparative lubricant composition CC2 |
|---|---|---|---|---|---|---|---|
| Polyisobutylene (Indopol H2100 ® marketed by the company INEOS) | | 2.40 | | 2.40 | | 2.40 | 2.40 |
| Package of additives (phenolic-type antioxidant, polymethacrylate pour point depressant, zinc dithiophosphate anti-wear, succinimide derivative, sulfonate detergent and calcium phenate) | 8.86 | 8.86 | 8.86 | 8.86 | 8.86 | 8.86 | 8.86 |

EXAMPLE 7

Storage Stability Evaluation of the CL5, CL6, CL7, CL8, CL9 and CL10 Lubricant Compositions This visual evaluation is identical to that of example 4.

The results are described in Table 7.

TABLE 7

| | CL5 | CL6 | CL7 | CL8 | CL9 | CL10 |
|---|---|---|---|---|---|---|
| Stability in storage | Stable | Stable | Stable | Stable | Stable | Stable |

The results show that the lubricant compositions according to the invention are stable over time.

EXAMPLE 8

Evaluation of the Oxidation Resistance of the Lubricant Compositions CL5, CL6, CL8, CL9, CL10 and of the Lubricant Composition CC2

This evaluation is identical to that described in Example 2.

The results are described in Table 8.

TABLE 8

| | CL5 | CL6 | CL7 | CL8 | CL10 | CC2 |
|---|---|---|---|---|---|---|
| Oxidation resistance (%) | 15 | 12 | 18 | 15 | 13 | 14 |

The results show that a lubricant composition according to the invention has good resistance to oxidation.

EXAMPLE 9

Evaluation of the Detergency Properties of the Lubricant Compositions CL5, CL7 and CL9

This evaluation is identical to that described in Example 5.

The results are described in Table 9.

TABLE 9

| | CL5 | CL7 | CL9 |
|---|---|---|---|
| Piston merit rating | 9.6 | 7.8 | 9.6 |

The results show that the lubricant compositions according to the invention have improved detergency properties, especially at high temperature.

EXAMPLE 10

Evaluation of the Detergency Properties of the Lubricant Compositions CL5, CL6, CL7, CL8, CL9 and CL10

This evaluation is performed by an MCT test in accordance with GFC L-27-T-07 The higher the value of the rating, the better are the detergency properties of the lubricant composition.

The higher the temperature of the appearance of the first varnishes, the better the detergency properties at high temperatures.

The results are described in Table 10.

TABLE 10

| | CL5 | CL6 | CL7 | CL8 | CL9 | CL10 |
|---|---|---|---|---|---|---|
| Piston merit rating | 7.1 | 7.3 | 7.0 | 7.2 | 7.3 | 7.6 |
| Temperature at appearance of the first varnishes (° C.) | 236 | 238 | 235 | 241 | 232 | 243 |

The results show that the lubricant compositions according to the invention have improved detergency properties, especially at high temperature.

The results also show that the addition of polyisobutylene makes it possible to further improve the detergency properties, especially at high temperature.

EXAMPLE 11

Preparation of a Lubricant Composition According to the Invention

The various components of the lubricant composition according to the invention CL11 are mixed according to the nature and the quantities of products presented in Table 11.

The percentages indicated correspond to weight percentages.

TABLE 11

| | Lubricant composition according to the invention CL11 |
|---|---|
| Group II oil (KV100 = 12 $mm^2/s$ measured according to ASTM D445) | 78 |
| Polyol ester (Priolube 1847 ® marketed by the company CRODA) | 9 |
| Package of additives (phenolic antioxidant, amine antioxidant, polymethacrylate pour point depressant, zinc dithiophosphate anti-wear) | 13 |

EXAMPLE 12

Evaluation of the Oxidation Resistance of the Lubricant Composition CL11

This evaluation is identical to that described in Example 2.

The results are described in Table 12.

TABLE 12

| | CL11 |
|---|---|
| Oxidation resistance (%) | 18 |

The results show that a lubricant composition according to the invention has good resistance to oxidation.

EXAMPLE 13

Evaluation of the Detergency Properties of the Lubricant Composition CL11

This evaluation is identical to those described in Example 5 and in Example 10.

The results are described in Table 13.

TABLE 13

| | CL11 |
|---|---|
| Piston merit rating (see example 5) | 8.4 |
| Piston merit rating (see example 10) | 8.1 |
| Temperature of appearance of the first varnishes (° C.) (see example 10) | 251 |

The results show that the lubricant compositions according to the invention have improved detergency properties, especially at high temperature.

The invention claimed is:

1. A method to improve the detergency properties of a lubricant composition for a gas engine, the lubricant composition comprising at least 50% by weight of mineral base oil, said method comprising adding to the lubricant composition from 5% to 15% by weight of polyol ester relative to the total weight of the lubricant composition, wherein the polyol ester is obtained by esterification of at least one carboxylic acid with at least one polyol, wherein said polyol comprises 6 OH groups and comprises from 6 to 10 carbon atoms, and wherein said carboxylic acid is a saturated and branched monocarboxylic acid comprising from 8 to 20 carbon atoms.

2. The method according to claim 1 wherein the gas engine is a stationary gas engine.

3. The method according to claim 1, wherein the lubricant composition comprises from 50% to 90% by weight of mineral base oil based on the total weight of the lubricant composition.

4. The method according to claim 1, wherein the polyol ester comprises a mixture of at least one first ester of polyol and of saturated or unsaturated monocarboxylic acid, linear or branched, and at least one second ester of polyol and of saturated or unsaturated monocarboxylic acid, linear or branched and that is different from the first ester.

5. The method according to claim 1, wherein the ester is obtained by esterification reaction between a polyol comprising 6 —OH groups, at least one first saturated or unsaturated monocarboxylic acid, linear or branched, and at least one second carboxylic acid selected from linear or branched, saturated or unsaturated dicarboxylic acids comprising at least 16 carbon atoms.

6. The method according to claim 1, wherein the lubricant composition further comprises polyisobutylene.

7. The method according to claim 1, wherein the polyol ester comprises a mixture of at least one first ester of polyol and of monocarboxylic acid comprising from 8 to 20 carbon atoms, and at least one second ester of polyol and of monocarboxylic acid comprising from 8 to 20 carbon atoms and that is different from the first ester.

8. The method according to claim 1, wherein the polyol ester comprises a mixture of at least one first ester of polyol comprising from 6 to 10 carbon atoms and of monocarboxylic acid, and at least one second ester of polyol comprising 6 —OH groups and of monocarboxylic acid and that is different from the first ester.

9. The method according to claim 1, wherein the ester is obtained by esterification reaction between a polyol comprising 6 —OH groups, at least one first monocarboxylic acid comprising from 8 to 20 carbon, and at least one second carboxylic acid selected from linear or branched, saturated or unsaturated dicarboxylic acids comprising at least 16 carbon atoms.

10. The method according to claim 1, wherein the ester is obtained by esterification reaction between a polyol comprising from 6 to 10 carbon atoms, at least one first saturated or unsaturated monocarboxylic acid, linear or branched, and at least one second carboxylic acid selected from linear or branched, saturated or unsaturated dicarboxylic acids comprising at least 16 carbon atoms.

11. The method according to claim 1, wherein the mineral base oil is chosen from a Group II base oil according to the API classification.

12. The method according to claim 1, wherein the carboxylic acid comprises from 8 to 18 carbon atoms.

13. The method according to claim 1, wherein formation of deposits on the at least one mechanical part of the engine is reduced or eliminated relative to use of a composition lacking at least one polyol ester.

14. A method to improve the detergency properties of a lubricant composition for a gas engine, the lubricant composition comprising at least 50% by weight of mineral base oil, said method comprising adding to the lubricant composition from 5% to 15% by weight of polyol ester relative to the total weight of the lubricant composition, wherein the polyol ester is obtained by esterification of at least one monocarboxylic acid with at least one polyol, said polyol being dipentaerythritol, and wherein said monocarboxylic acid is a saturated and branched monocarboxylic acid, comprising from 8 to 20 carbon atoms.

* * * * *